United States Patent [19]

Davidson

[11] 4,176,561

[45] Dec. 4, 1979

[54] LOW TOLERANCE ROTARY TO LINEAR TRANSMISSION

[75] Inventor: Donald R. Davidson, Berkely Heights, N.J.

[73] Assignee: The Singer Company, New York, N.Y.

[21] Appl. No.: 854,291

[22] Filed: Nov. 23, 1977

[51] Int. Cl.[2] ..... F16H 1/20

[52] U.S. Cl. ..... 74/424.8 A

[58] Field of Search ..... 74/424.8 A

[56] References Cited

U.S. PATENT DOCUMENTS

| | | | |
|---|---|---|---|
| 1,896,209 | 2/1933 | Vitale et al. | 74/424.8 A |
| 3,730,008 | 5/1973 | Sheesley | 74/424.8 A |

OTHER PUBLICATIONS

Siegl—Access Drive Mechanism—IBM Technical Disclosure Bulletin—vol. 13, No. 12, 5/12/71.

*Primary Examiner*—Samuel Scott
*Assistant Examiner*—Wesley S. Ratliff, Jr.
*Attorney, Agent, or Firm*—Michael H. Wallach; Robert E. Smith; Edward L. Bell

[57] ABSTRACT

A low tolerance device for converting the rotary motion of a motor shaft into linear motion for use in influencing the stitch bight and work feed mechanisms of a sewing machine. The shaft of a motor is provided with a worm rigidly attached thereto. Two half nut sections are clamped around the worm and are urged against it by a leaf spring. The half nuts are connected to a drive arm by a pin which freely passes through one half nut and the drive arm and is rigidly connected to the second half nut. The leaf spring acts as a guide for the half nuts and prevents their rotation about the worm. Rotation of the motor in either direction causes the half nuts to translate along the axis of the worm. The translation of the half nuts is transferred to the drive arm through the pin.

3 Claims, 3 Drawing Figures

LOW TOLERANCE ROTARY TO LINEAR TRANSMISSION

BACKGROUND OF THE INVENTION

1. Field of the Invention

The invention relates to sewing machine drive mechanisms, and particularly to a means for converting the rotary motion of a motor shaft into linear motion, through the use of low tolerance parts.

2. Description of the Prior Art

Rotary to linear motion converters are well known in the prior art. Needle stitch control and feed control mechanisms for sewing machine applications require precise control of the linear motion to insure stitch uniformity. Prior art used of rotary to linear motion conversion devices in sewing machines have heretofore required parts with high tolerances to insure the accuracy of the stitch and feed control. Such parts are costly to manufacture and require initial adjustments to insure their proper operation. These problems are minimized by the rotary to linear transmission device disclosed in this invention.

SUMMARY OF THE INVENTION

An object of the invention is to overcome the prior art limitations of converting rotary to linear motion for use in sewing machine drive mechanisms and permit the use of low tolerance components which automatically and continually adjust for wear. Another object of the invention is to eliminate the need for difficult initial adjustments. These objects of the invention are obtained by attaching a worm to the shaft of a motor which is biased to supply bi-directional rotary motion. Two half nuts threadedly engage opposite sides of the worm. A pin is rigidly attached to one half nut and passes through a drive arm and the second half nut. The half nuts are urged against the worm by a leaf spring that is so shaped to bear against the body of the half nuts to prevent their rotation and to further act as a flexible guide upon which the nuts can translate.

Rotation of the worm results in linear motion of the drive arm by the coaction of the threads of the half nuts and the threads contained on the worm. The use of a leaf spring to urge the half nuts against the worm permits the invention to be carried out with low tolerance parts which are easy to manufacture, assemble, and which are self adjusting.

Other objects and advantages of the invention will be best understood on reading the following detailed description with the accompanying drawings.

DESCRIPTION OF THE DRAWINGS

In the accompanying drawings of a preferred embodiment of this invention:

Referring to FIGS. 2 and 3 of the drawings, a drive means 10, for example a stepper motor, is fastened to a mounting bracket 12. A shaft 14 of the drive means 10 has a threaded worm 16 rigidly attached thereto, such that the worm is made rotatable by the drive means. Split nuts 22 and 24 are formed with internal threads complemental to the threaded worm 16, and the split nuts are arranged on opposite sides of the threaded worm in mesh therewith. Shoulders 40 and 42 extend outwardly from the split nuts in a plane parallel to the axis of the worm and in clearance of the thread on the worm. FIG. 3 shows a pin 28 rigidly attached to shoulder 40 of split nut 22. The shoulder 42 of the split nut 24 contains an aperture 36 for slidably receiving the pin 28. One end of the drive arm 26 contains an aperture 38. The pin 28 slidably passes through the aperture 38 to restrain the drive arm between the split nuts 22 and 24.

FIG. 2 shows leaf spring 18 fastened to drive means 10 by fasteners 20. The ends of the leaf spring 18 are curved at 30 and 32 to press forcibly on the flat surfaces 44 and 46 of split nuts 22 and 24.

FIG. 3 also shows split nuts 22 and 24 disposed diametrically opposite to each other about the circumference of worm 16. Leaf spring ends 30 and 32 are so shaped to urge split nuts 22 and 24 against worm 16, and further to prevent the split nuts from rotating about worm 16.

Figure 1:
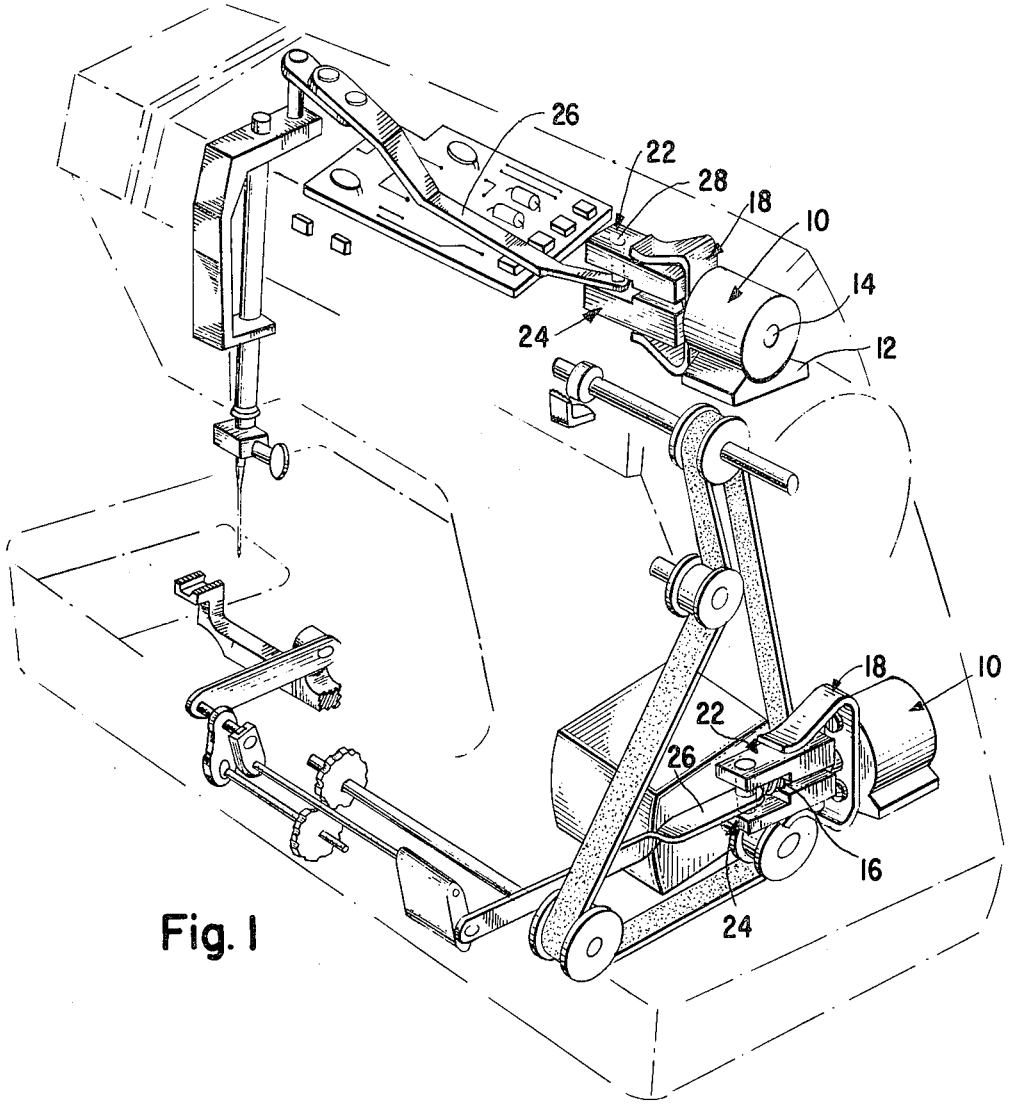
FIG. 1 is a perspective view of a portion of a sewing machine in phantom having one rotary to linear transmission device in accordance with this invention applied to control the feed and another to control the stitch bight.
Figure 2:
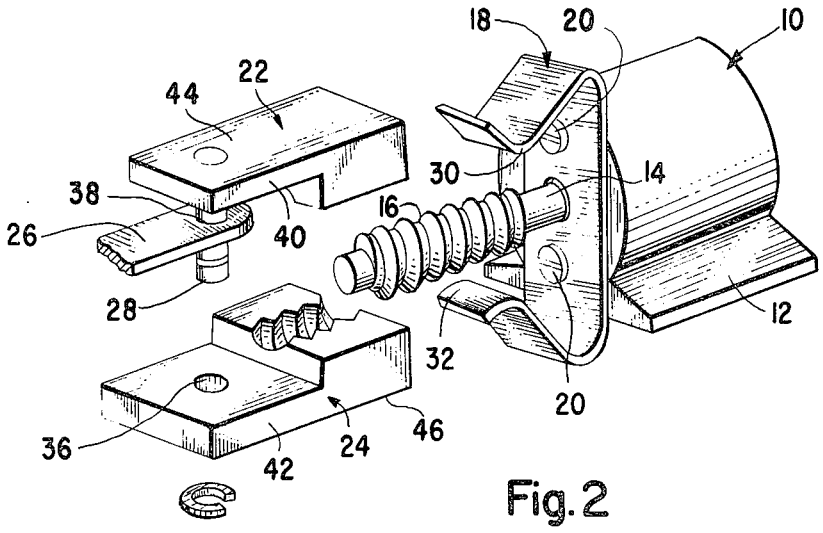
FIG. 2 is a disassembled perspective view of the rotary to linear transmission device showing a drive means attached thereto.
Figure 3:
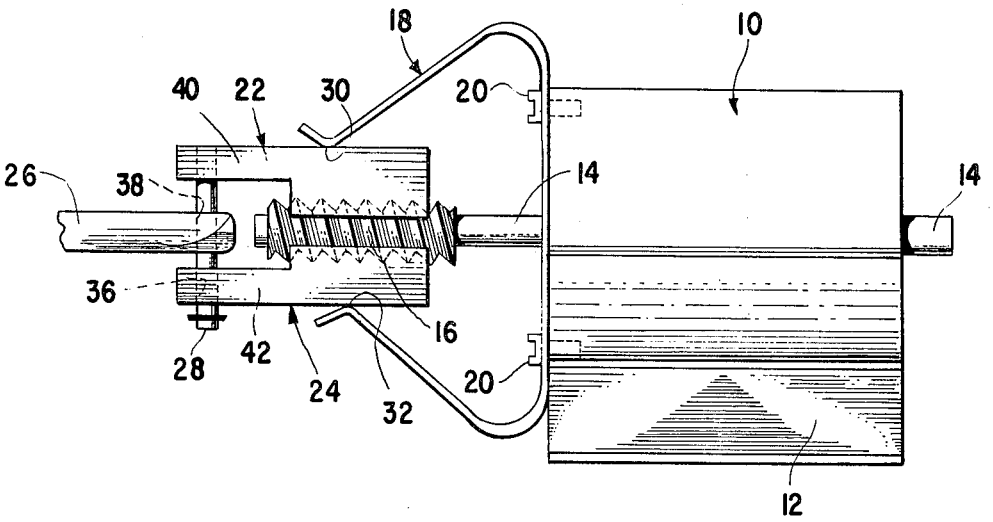
FIG. 3 is a side view of the rotary to linear transmission device.

Power applied to drive means 10 causes the worm 16 to rotate. The teeth of split nuts 22 and 24 engage the teeth of worm 16 and attempt to rotate about worm 16. The leaf spring 18 arrests their rotation. The split nuts instead translate along worm 16 with leaf spring ends 30 and 32 forcing the split nuts and the worm into intimate contact with each other. The translation of split nuts 22 and 24 along the axis of worm 16 is transferred to drive arm 26 through pin 28. The drive arm 26 may be caused to reciprocate along its longitudinal axis by reversing the direction of rotation of drive means 10.

Wear which occurs in worm 16 and split nuts 22 and 24 is adjusted for by the inward force of leaf spring ends 30 and 32 which urge the split nuts against worm 16, thereby continually adjusting for wear between the worm and the split nuts. It is to be noted that an additional advantage of the leaf spring 18 continually urging the split nuts against the worm is that low tolerance parts can be employed for the worm and the split nuts without incurring any appreciable lost motion between the worm and the split nuts.

FIG. 1 shows a rotary to linear transmission device constructed in accordance with the teachings of the present invention applied to a sewing machine to influence the stitch feed and the stitch bight. It will be appreciated by one skilled in the art of sewing that rapid and accurate motion of the feed dog and needle are required during the sewing process to insure the proper formation of stitches. Small changes in the position of the feed dog which moves the material past the needle and the mechanism which jogs the needle bar across the direction of material feed may be had by the use of a rotary to linear transmission device of a design similar to that described herein when driven by a stepper motor of a conventional design. The stepper motor is capable of producing small incremental arcuate rotation of the worm 16 which will produce small incremental excursions of the drive arm 26. It will also be appreciated that since the direction of rotation of the stepper motor may be rapidly changed, the motion of the feed dog and needle bar may be accurately controlled.

Having thus set forth the nature of this invention, what is claimed herein is:

1. A device for converting rotary motion into linear motion for use in influencing the stitch bight and work feed mechanisms of a sewing machine comprising a mounting base, a shaft journaled in said base, drive means for imparting rotary motion to said shaft, a threaded worm rigidly mounted on said shaft, a pair of threaded split nuts disposed about said worm each in meshing relation therewith, a drive arm pivotally connected to said split nuts, and resilient means anchored on said mounting base and engaging each of said split nuts for urging said split nuts against said worm and for guiding said split nuts along the axis of said worm, whereby rotational motion of said worm is converted into translational motion of said drive arm along the axis of said worm.

2. A device for converting rotary motion into linear motion for use in influencing the stitch bight and work feed mechanism of a sewing machine as set forth in claim 1 in which said means for urging said split nuts against said worm and guiding the translational motion of said split nuts is a leaf spring.

3. A device for converting rotary motion into linear motion for use in influencing the stitch bight and work feed mechanisms of a sewing machine as set forth in claim 1 in which said drive means is a stepper motor.

* * * * *